United States Patent [19]

Kulp et al.

[11] Patent Number: 4,859,983

[45] Date of Patent: Aug. 22, 1989

[54] PLASTIC BARRICADE

[75] Inventors: Jack H. Kulp, San Juan Capistrano; Carl L. Erwin, Brea, both of Calif.

[73] Assignee: Signal, Inc., LaMirada, Calif.

[21] Appl. No.: 208,865

[22] Filed: Jun. 15, 1988

Related U.S. Application Data

[63] Continuation of Ser. No. 790,885, Oct. 24, 1985, abandoned.

[51] Int. Cl.[4] ..... E01F 9/04

[52] U.S. Cl. ..... 340/908.1; 116/63 P; 256/64; 404/6

[58] Field of Search ..... 340/114 B, 114 R, 81 R, 340/107; 256/64, 65, 13.1; 116/63 R, 63 P; 404/6–10; 40/606, 610, 612; 403/83, 84, 11; 414/30; 206/509

[56] References Cited

U.S. PATENT DOCUMENTS

| | | | |
|---|---|---|---|
| 2,763,517 | 9/1956 | Strand | 403/96 |
| 2,863,238 | 12/1958 | Keech | 40/606 |
| 3,321,742 | 5/1967 | Nunn, Jr. | 340/114 B |
| 3,365,209 | 1/1968 | Fischer | 403/96 |
| 3,527,434 | 9/1970 | Mauro | 40/610 |
| 3,802,667 | 4/1974 | Kanan | 256/64 |
| 3,875,280 | 4/1975 | Story | 425/388 |
| 3,877,681 | 4/1975 | Humphrey | 256/64 |
| 4,004,545 | 1/1977 | O'Donnell | 116/63 P |
| 4,083,670 | 4/1978 | Reifers et al. | 425/398 |
| 4,183,317 | 1/1980 | Follick | 116/63 P |
| 4,253,260 | 3/1981 | Maza et al. | 116/63 P |
| 4,597,706 | 7/1986 | Michit | 414/30 |
| 4,624,210 | 11/1986 | Glass | 116/63 P |
| 4,674,432 | 6/1987 | Schmanski | 116/63 R |

FOREIGN PATENT DOCUMENTS

| | | | |
|---|---|---|---|
| 3226711 | 1/1984 | Fed. Rep. of Germany | 414/30 |

*Primary Examiner*—Joseph A. Orsino
*Assistant Examiner*—Brent A. Swarthout
*Attorney, Agent, or Firm*—Cohn,Powell & Hind

[57] ABSTRACT

A traffic barricade of the A-frame type constructed of a lightweight material such as plastic to have a forbidding appearance. The barricade members are unitarily constructed to be interchangeable and with integral hinge mechanisms. The hinge mechanisms have detenting elements for improving the resistance to winds tending to cause the closure of the "A" stance of the barricade. The barricade permits a damaged hinge element to be readily replaced. Ballast may be added to a storage compartment arranged adjacent the supporting surface for the barricade. The design of the plastic barricade permits a warning light to be directly secured by a mounting bolt functioning as a hinge pin. The individual barricade members may be stacked with substantially no relative movement of the stacked members.

19 Claims, 5 Drawing Sheets

FIG. 1.
PRIOR ART
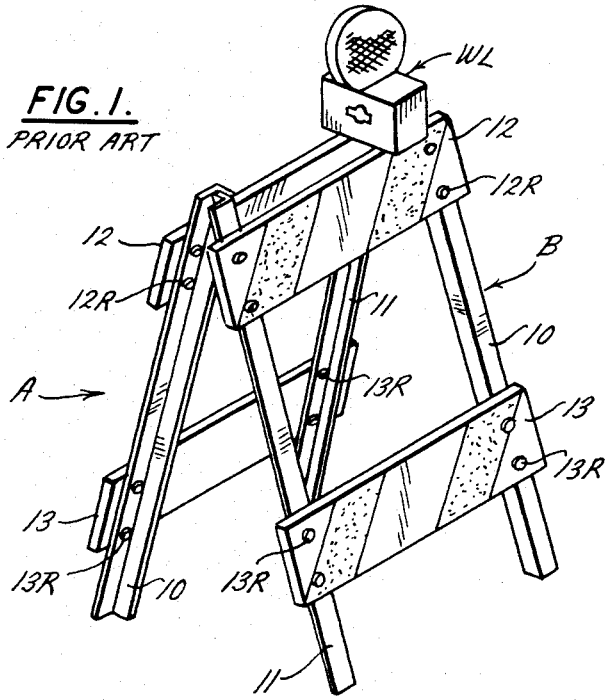
FIG. 2.
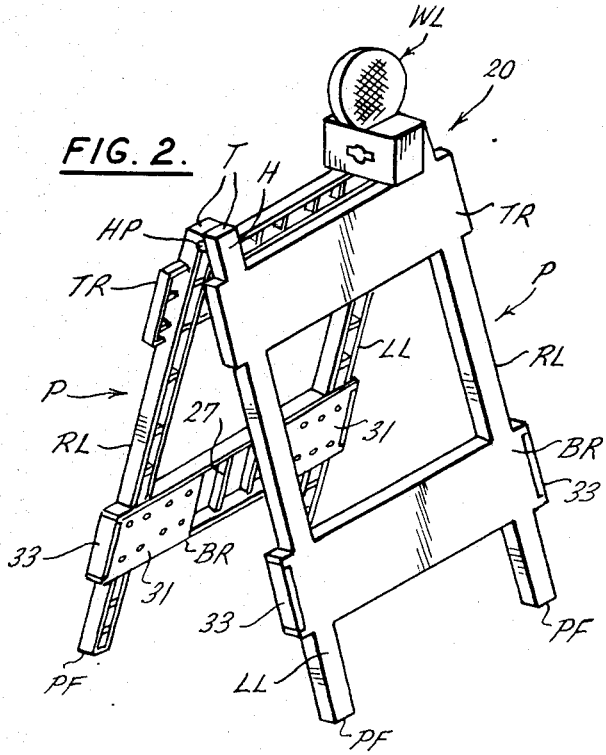
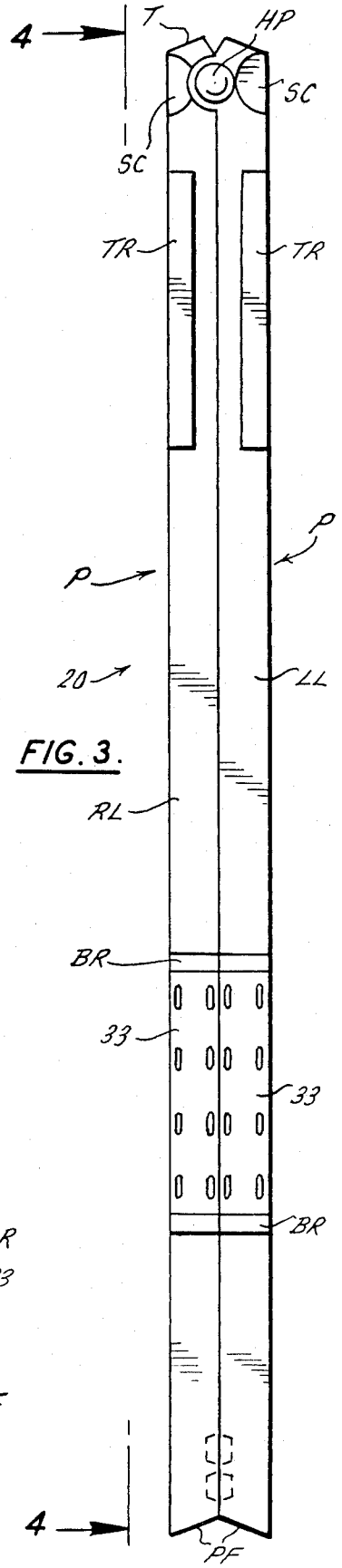
FIG. 3.

20
5
T
SC
HP
SCL
SCL
H
H
SM
50
P
S
22
21
TR
5
23
24
LL
LL
24
4
23
BR
31
32
33
30
33
S
27
28
29
23
4
24
PF
PF

FIG. 5.
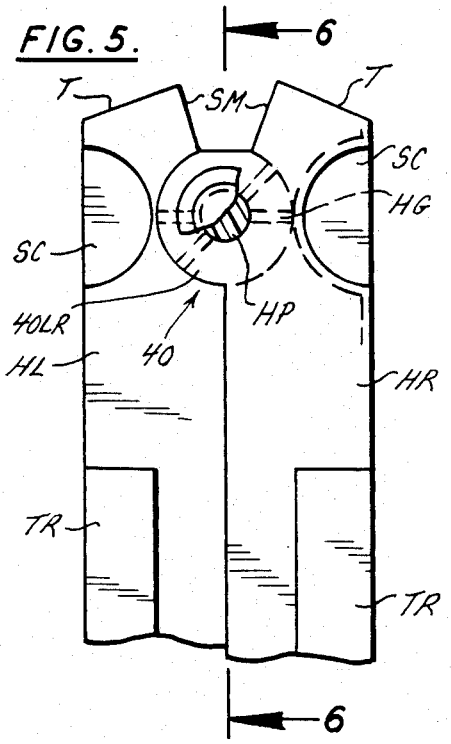
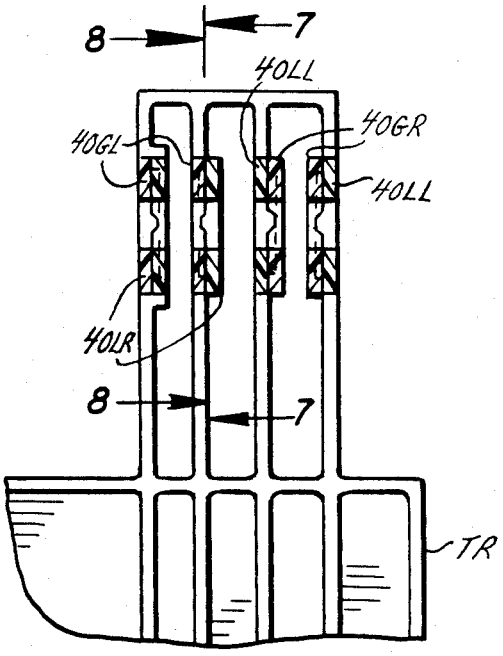
FIG. 6.
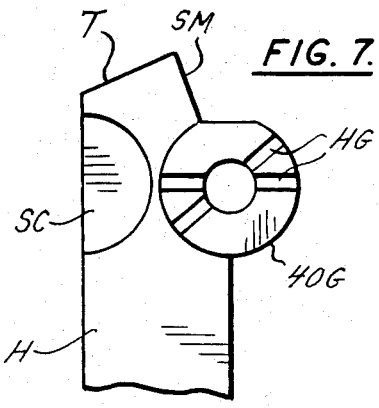
FIG. 7.
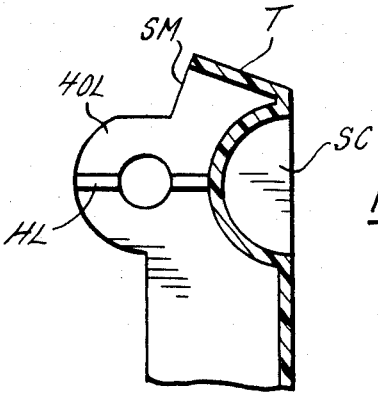
FIG. 8.
FIG. 9.
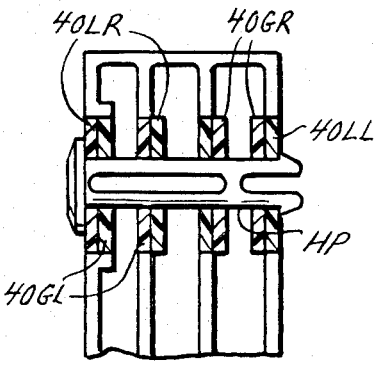
FIG. 10.
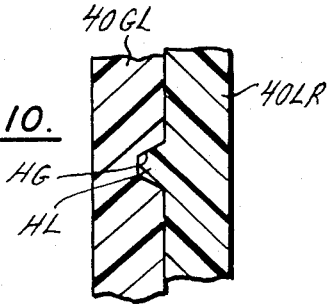

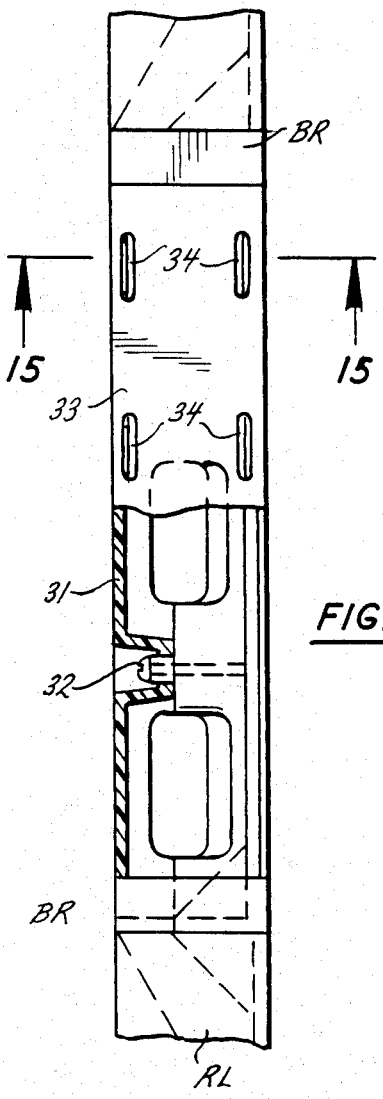
FIG. 14.
FIG. 15.
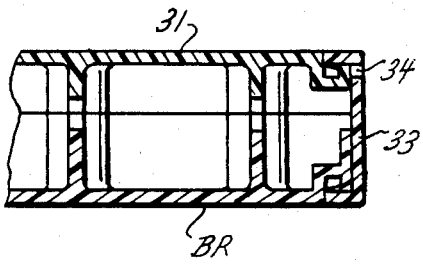
FIG. 16.
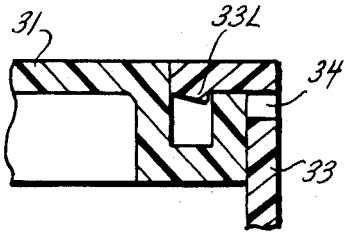
FIG. 18.
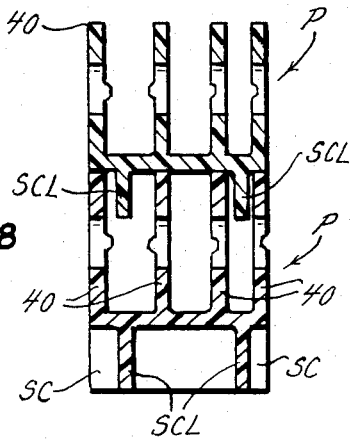
FIG. 17.
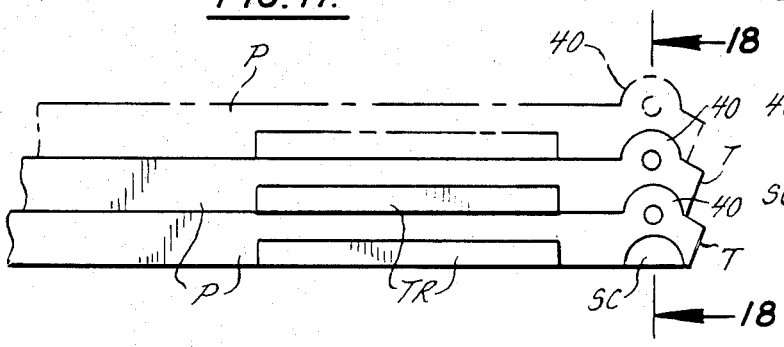

PLASTIC BARRICADE

This is a continuation of co-pending application Ser. No. 790,885 filed on Oct. 24, 1985, now abandoned.

FIELD OF INVENTION

This invention relates to traffic control devices and, more particularly, to a plastic barricade of the A-frame type for controlling traffic by closing, restricting or delineating all or a portion of a right of way.

BACKGROUND OF INVENTION

Barricades have been in use for a long period of time for controlling traffic by providing a physical barrier to all or portions of a right of way so that it is clearly visible to a motorist to permit the motorist to readily avoid the barricaded area on a road, highway or the like. One of the common types of barricades presently in use is a barricade having an A- frame design. The conventional barricade of the A - frame type consists of two barricade members that are constructed of angle iron legs and upper and lower planar rails constructed of wood that are riveted between a pair of the angle-iron legs. Each barricade member is a pivotably secured together at the tops of the angle-iron legs. The rails for the barricade are generally marked with stripes of alternate colors such as orange and white or black and white. The markings have been conventionally provided by the application of commercially available reflective sheeting that is adhesively secured to the planar surfaces of the rails. The A-frame barricade has conventionally mounted a warning light, either of the flashing type or the "steady burn" design. The warning lights of the steel-wooden A - frames have been secured by a securing bolt also functioning as a pivot pin for the angle irons. As a result of the long period of use of this type of A-frame barricade, it has become readily recognizable to the motoring public, including the fact that they are constructed of steel and wood so that intelligent motorist attempt to avoid impacting such a barricade with their motor vehicles and thereby avoid damaging their vehicles or causing any other damage due to the impact between the barricade and the vehicle. Presently some states prohibit the placement of wooden-steel barricades on high speed highways or the like as they are inherently too dangerous for use thereon. In view of the disadvantages of the steel-wood construction of the A-frame type barricade, plastic barricades have been developed and have been extensively used.

Prior art plastic barricades are disclosed in U.S. Pat. Nos. 3,880,406; 3,950,873; and 4,298,186. A lightweight traffic barricade constructed of cardboard is disclosed in U.S. Pat. No. 4,383,782. The use of known prior art, commercially available plastic barricades has revealed certain problems and deficiencies attendant to their use. Present day plastic barricades are lighter in weight than a steel-wood constructed barricade and are more responsive to the steady impact of winds and wind gusts that tend to topple them over. A typical prior art plastic barricade weighs in the range of 8 to 11 pounds, while a steel-wood barricade weighs on the order of 22 pounds. The lower weight of a plastic barricade renders it less stable than one constructed in the conventional fashion from heavy materials such as wood and steel. When the plastic barricade of the A-frame type or even the wooden-steel barricade is impacted by winds or gusts of winds, the wind imparts a force to the rails or cross members of the barricades, tending to lift up the front legs of the barricade, thereby causing the front legs to move towards the rear legs, thereby reducing the desired stable spacing between the legs. This type of response to winds may progressively move the front legs toward the rear legs until the barricade falls over due to the unstable spacing between the legs.

Plastic barricades of the A-frame type have conventionally been ballasted with sand, sand bags or the like to add weight thereto for rendering them more stable and less responsive to wind and wind gusts. Preferably sufficient weight is added to approach the weight of a conventional wood-steel barricade. The present day prior art plastic barricades are designed to permit the ballast to be positioned in the hollow legs or cross members of the barricade. These prior art barricades are typically moved upwardly in response to an impact from a motor vehicle, particularly when the added ballast renders them top heavy. No prior art plastic barricade is known that is constructed and designed for minimizing the closing action of the legs of a plastic barricade, other than through the use of ballasting and the use of a spreader bar to force the legs apart, due to the aforementioned wind action.

It has also been determined that the weakest point of a plastic barricade of the A-frame type is the design of the hinge mehcanism for permitting the barricade legs to be pivoted relative to one another. When an impact to the barricade results in damages to or breaking of the hinge mechanism, the entire barricade or at least one half of the barricade may be rendered useless so that the damaged barricade members must be replaced with barricade members having operable hinge mechanisms. A major flaw in the prior art plastic barricades is that no convenient method is provided for securing a warning light directly to the barricade. Warning lights are usually secured to a metal or plastic strap attached to the top of the barricade to be used with a bolt running between the strap and the warning light. The methods of producing prior art types of plastic barricades includes blow molding and roto casting techniques to form a hollow device with relatively thick wall sections which can be internally ballasted. In addition, structural foam injection molded designs for plastic barricades have relatively thick wall sections so they also are more likely to be less forgiving and pliable and therefore will also be damaged or crushed when a motor vehicle is driven over the barricade. Accordingly, an improved, more reliable, wind resistant, damage-proof plastic barricade of the Aframe type is needed in the art.

SUMMARY OF THE INVENTION

The present invention provides an improved relatively inexpensive plastic barricade of the A-frame design that is safer to use and is less susceptible to damage to itself and to an errant motor vehicle driver. The plastic barricade of the present invention is molded with thin wall sections from an impact and crush resistant, resilient material with sufficient memory to substantially regain its original condition after being run over by a motor vehicle or the like, thereby minimizing damage to the barricade. The improved construction of the plastic barricade of the present invention includes the provision of a replaceable hinge mechanism so as to permit the barricade proper to be useful with need for replacing the entire unit in the event of damage to the hinge mechanism. The hinge mechanism is advantageously constructed for improved wind resistance in accordance with the present invention to minimize the closing of the A-frame stance of the barricade due to being subjected to winds tending to close and/or gradually close the barricade, leading to the barricade falling over. Wind resistance is also improved by ballasting the lightweight barricade. The ballast is added at a point adjacent the bottom end rather than the top of and the legs of the barricade to cause the barricade to move toward the supporting surface upon being impacted rather than to be launched upwardly in response to a motor vehicle impact. This renders the barricade of the present invention safer to use.

The barricade of the present invention is constructed of two interchangeable, replaceable barricade members to define an "A" frame, thereby reducing the cost of manufacturing and inventory problems as when non-interchangeable members (lefts and rights) are utilized. The barricade members are constructed and defined to allow commercially available sheeting to be readily and inexpensively applied to a plurality of barricade members. The barricade members are defined to allow a warning light to be readily secured thereto, in a non-rotatable position, by utilizing the light securing member as a hinge pin for the barricade as well. The barricade members are defined with stop members to limit the opening movement of the barricade members in the "A" stance and to place the feet of the barricade members in full engagement with the supporting surface when the barricade is fully opened. The barricade members per se are further defined to be stacked in an interlocked relationship so as to prevent relative movement between the stacked barricade members.

From a structural standpoint, the present invention comprehends an improved plastic traffic barricade of the A-Frame type including first and second barricade, planar members constructed and defined for forming an A-frame barricade when the members are pivotally secured together. Each of the barricade members is similarly constructed with thin wall sections of a lightweight material that will yield when impacted by a motor vehicle so as to minimize any damage to the motor vehicle and the barricade. Each of the barricade members includes an integral hinge member adjacent opposite sides of each barricade member and extends as pre-selected distance from an end of the barricade member for a pivotal co-action with the corresponding hinge member of another barricade member when the two barricade members are pivotally secured together. The hinge means for each of the hinge members pivotally secure the corresponding hinge members for each barricade member to permit the barricade members to be moved to a closed position, in a side-by-side relationship, and an open position with the free ends of the barricade members being spaced apart in an A-frame configuration. Each of the integral hinge members are constructed and defined for substantially minimizing any closing pivoting action or gradual closing pivoting action of the barricade members when they are arranged in an A-frame configuration in response to closing forces impacting the barricade members.

The barricade members for the improved traffic barricade are constructed and defined at the upper ends thereof for providing stop means for limiting the pivotal open position of the barricade members that also positions the ground engaging ends of the barricade members in substantially full contact with the supporting surface. Each of the barricade members is further defined with a pair of rail members, with the lower rail member being constructed and defined for mounting ballast therein for improving the wind resistance of the thus-defined traffic barricade. The hinge elements for the barricade of the present invention extend a pre-selected distance above the top rails for each of the barricade members to permit each of the hinge members to be severed from its integral relationship with the barricade member in the event a hinge member is rendered inoperative so it can be readily replaced by a replacement hinge member that can be secured to the individual barricade member at the location previously occupied by the severed hinge member.

BRIEF DESCRIPTION OF THE DRAWINGS

These and other features of the present invention may be more fully appreciated when considered in the light of the following specification and drawings, in which:

FIG. 1 is a side perspective view of a prior art barricade of the A- frame type constructed of steel and wood with a warning light secured thereto;

FIG. 2 is a side perspective view of a lightweight traffic barricade of the A- frame type with a light secured to it and embodying the present invention;

FIG. 3 is an enlarged end view of the barricade of FIG. 2, with the light removed therefrom, and with the barricade members arranged in a completely closed position, side by side;

FIG. 5 is a partial, end elevational view illustrating the closed hinge mechanism, taken along the line 5—5 of FIG. 4;

FIG. 6 is a partial, sectional view, taken along the line 6—6 of FIG. 5, illustrating the co-acting relationships of the elements of the hinge mechanisms with the hinge pin removed;

FIG. 7 is a partial, elevational view, taken along the line 7—7 of FIG. 6, illustrating an element of the hinge mechanism with the detenting grooves therein;

FIG. 8 is a partial, elevational view, taken along the line 8—8 of FIG. 6, illustrating an element of the hinge mechanism with the detenting land therein;

FIG. 9 is a partial, sectional view of the co-acting elements of the hinge mechanisms of the barricade members and illustrating the hinge pin in position;

FIG. 10 is a partial cross-sectional view, illustrating the locked relationship of the detenting lands and grooves for the hinge members;

FIG. 14 is a partial view of an end cap of the ballast storage compartment as viewed along the line 14—14 of FIG. 4;

FIG. 15 is a partial sectional view of the ballast storage compartment taken along the line 15—15 of FIG. 14;

FIG. 16 is an enlarged detail of the end cap secured to the ballast storage compartment, as illustrated in FIG. 15;

FIG. 17 is a partial elevational view of a number of detached, stacked barricade members; and FIG. 18 is a cross-sectional view taken along the line 18—18 of FIG. 17 of the interlocked ends of the barricade members.

DETAILED DESCRIPTION OF THE PREFERRED EMBODIMENT

Figure 4:
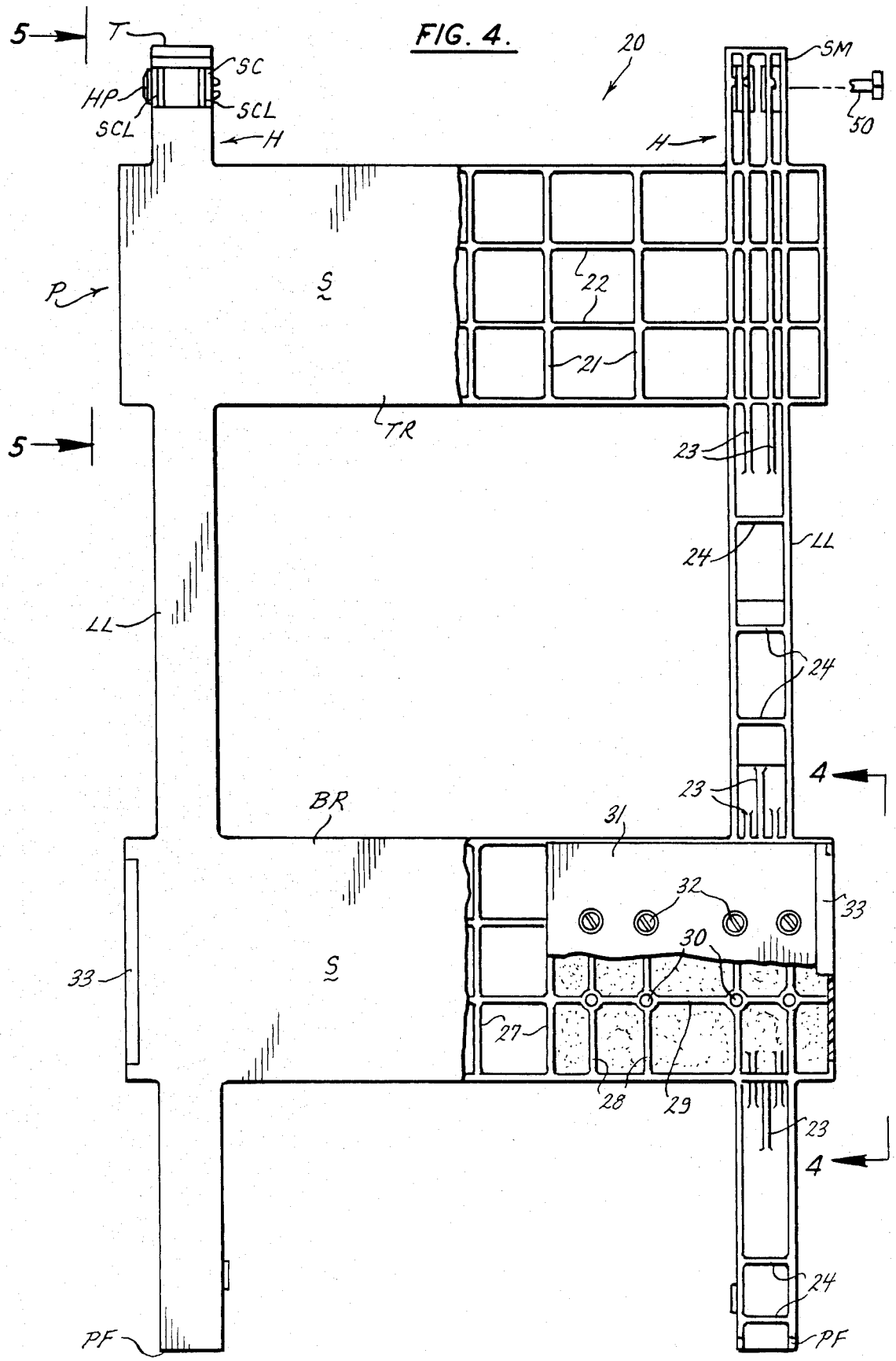
FIG. 4 is a side elevational view, with portions broken away, taken along the line 4—4 of FIG. 3.

Prior to describing the present invention, an understanding of a typical prior art barricade of the A-frame type will aid in understanding the invention. A prior art barricade of the A-frame type and constructed of steel and wood is illustrated in FIG. 1. The barricade consists of two barricade members A and B that are pivotably secured together. Each barricade member A and B includes a pair of spaced legs 10 and 11 constructed from steel angle iron elements, as illustrated, The legs 10 and 11 are secured together by a pair of rails members 12 and 13. The rail member 12 and 13 are constructed of wood and are riveted to the legs 10 and 11 by the rivets 12R and 13R adjacent the ends of the rail members 12 and 13 for defining a barricade member. Both barricade members A and B are similarly constructed. The rail members 12 and 13 extend a preselected distance outwardly from the legs 10 and 11. The legs 10 and 11 for co-acting members A and B are secured together adjacent their top ends by pivot pins (not shown) for pivotal movement between a closed position and an open position. The open position is illustrated in FIG. 1 and when the barricade members A and B are pivoted towards one another, they can be arranged in a side-by-side relationship. As illustrated in FIG. 1, the prior art barricade includes a commercially available warning light WL secured thereto. The warning lights are commercially available from the Signal Division of Lear Siegler, Inc., of 16330 Phoebe Avenue, La Mirada, Calif. 90637. The commercially available warning light WL is provided with a mounting aperture for threadably receiving a mounting bolt so as to secure the warning light WL in position. In the prior art type of barricade illustrated in FIG. 1, the securing bolt is utilized as a hinge pin for securing the barricade members A and B together while also securing the warning light to the barricade proper. As illustrated in FIG. 1, the bottom of the housing for the warning light WL rests on the tops of the rail members 12 when the securing member is secured to the warning light WL and the barricade members A and B are pivoted in the typical A stance illustrated. The securing member is conventionally a theft-deterent bolt. The rail members 12 and 13 may be provided with markings and are illustrated in FIG. 1 with commercially available sheeting adhesively bonded to the front, planar surfaces of the rail members 12 and 13.

Now referring to the remaining drawings, the barricade 20 of the present invention will be described in detail. the barricade 20 is constructed and defined of two interchangeable/replaceable barricade members P adapted to be pivotally secured together to assume an A-frame stance, as illustrated in FIG. 2. Each of the barricade members P is constructed of a lightweight material that will yield when impacted by a motor vehicle so as to minimize any damage to the motor vehicle and the barricade 20. In the preferred embodiment of the invention, the lightweight material selected is a plastic that allows the barricade members P to be injection molded with thin wall sections. Consistent with the improved safety in the use of the barricade 20, the lightweight material selected for the barricade 20 allows it to be produced by injection molding of a crush resistant, resilient plastic, such as a commercially available linear polyethylene plastic. The plastic selected should have sufficient resilience so as to yield when impacted and yet sufficient memory to spring back to its original condition when it is crushed as when it is driven over by a motor vehicle. To this end the barricade 20 is constructed of thin wall sections up to ⅛ inch thick that will not break when it is travelled over by a motor vehicle including a heavy truck. The plastic should be sufficiently stable to high temperatures, such as when it is used in the desert areas, so that the legs of the barricade 20 will not bow in response to being subjected to a high temperature for long periods of time. The selection of a linear polyethylene plastic material fulfills the aforementioned criteria and permits the barricade members P to be injection molded with this wall sections. The prior art plastic barricades that are blow molded or injection foam molded, have thicker wall sections than the injection molded sections of the present invention and are more easily damaged or broken than the barricade 20. To our knowledge all known prior are plastic barricades break if run over by a motor vehicle unlike the barricade 20 of the present invention.

The barricade 20 is also constructed and defined to have an overall appearance the same as that of barricades of the prior art constructed of wood and steel, as illustrated in FIGS. 1 and 2, so that the motor vehicle operators tend to avoid engagement with the barricade 20 with their motor vehicles as they have in the case of the prior art devices of FIG. 1. For this purpose, the barricade members P are constructed as planar elements with a right leg RL and a left leg LL constructed integrally with a pair of parallel rails arranged adjacent opposite ends of the planar structure defined for the barricade members P. The top rail is identified by the rail TR, while the bottom rail is identified as the rail BR. The barricade members P each include integral hinge members H adjacent the opposite sides of each member that extends a preselected distance from the top end of the top rail TR for coaction with the corresponding hinge member H of a similarly constructed barricade member P when the members P are pivotally secured at the hinge members H. The pair of barricade members P are illustrated in FIG. 2 with the hinge member H coupled together by means of a hinge pin HP. The hinge members H, on the opposite side of the barricade members P, are illustrated as mounting a warning light WL and which warning light is secured by a securing member or antitheft bolt of conventional construction that also functions as the hinge pin for the co-acting hinge members, as will be explained more fully hereinafter. The hinged barricade members P are illustrated in FIG. 2 in their open position or the familiar A-frame stance. When they are pivoted towards one another, they will be aligned side by side, as illustrated in FIG. 3.

Since the barricade members are identically constructed so as to be interchangeable, only one member P needs to be examined in detail and reference to FIG. 4 will reveal the detailed construction of the molded barricade member P. The barricade member P illustrated in FIG. 4 best illustrates the construction of the barricade member P in both elevation and with the portions broken away to illustrate the detail of the "waffle" pattern of reinforcing construction for the barricade member P. Each barricade member P includes the pair of spaced legs RL and LL extending from a supporting surface to the top of the hinged members H. The legs RL and LL are integrally constructed with the top rail member TR and the bottom rail member BR. The top surface of top rail member TR is spaced a pre-selected distance from the hinge members H and the bottom surface of the bottom rail member BR is spaced a pre-selected distance from the ends of the legs RL that engage the supporting surface. These ends are cut at an angle so that they define a flat surface parallel to the supporting surface when they are arranged in the A-frame stance illustrated in FIG. 2. The angular configuration of the barricade legs are identified as the feet PF in FIG. 3. The angle for the feet PF is selected to fully engage the supporting surface and firmly place them in full contact with the supporting surface when the barricade members P are opened or pivoted to their full extent as controlled by the stop members for the members P, as will be explained hereinafer. As is clear from examining FIG. 4, the top rail member TR has an outer planar surface S with the inner surface constructed of a waffle-like pattern of ribs for imparting strength and rigidity to the barricade member. The legs RL and LL are also molded with a number of ribs for strength and rigidity of the legs.

As illustrated in FIG. 4, the right-hand side of the top rail TR is illustrated with its thin outer wall cut away to reveal the waffle-like grid of elements 21 and 22 that are formed on the inside of the rail TR or the side opposite to the planar surface S. The structural reinforcing elements 21 run vertically from the top to the bottom of the inside surface of the top rail TR in a preselected spaced relationship while the structural elements 22 are arranged in a horizonally spaced relationship from end to end of the rail TR. Similarly, the barricade legs have structural reinforcing elements 23 that are spaced apart on the inside surfaces of the legs and run vertically adjacent the top portion of the rail from above the top rail TR to a pre-selected distance below the rail TR. Below the elements 23, horizontal reinforcing elements 24 are arranged in a vertically spaced relationship on opposite sides of the bottom rail BR. The top ends T of the barricade legs are provided with an inclined surface corresponding to the angle selected for the feet PF to lie in the same plane when the barricade 20 is fully opened; see FIG. 2. The same angular relationship is utilized for the stop member SM defined on the inside surfaces of the barricade legs and above the hinge mechanisms H; see FIG. 5. The stop members SM of co-acting barricade members P engage one another when the members P are fully opened and thereby prevent further opening movement of the barricade members P. At this time the barricade members P will not only be fully open, but the feet PF will be in full contact with the surface supporting the barricade 20.

The bottom rail BR is also integrally molded with the legs RL and LL and the top rail TR. The outside surface of the bottom rail BR or the surface S visible to the motor vehicle operator is a planar surface as is the surface S for the top rail TR. The surfaces S may be utilized to mount commercially available sheeting of alternate coloring (not shown) as in FIG. 1. The upper and lower longitudinal edges of the rails TR and BR may be provided with guards (not shown) that extend above the top surfaces S of the rails to prevent the expensive reflective sheeting from being damaged when knocked to the ground or during shipping and handling. The bottom rail BR is also structurally defined on its inside surface with reinforcing ribs but also is constructed and defined on its inside surface with a pair of ballast storage compartments adjacent each end. The central portion of the inside surface of the bottom rail BR is provided with a waffle-like pattern of horizontal and vertical, spaced, reinforcing elements similar to the elements 27 that extend essentially the entire width of the rail BR. The inside surfaces of the ends of the bottom rail BR are each constructed similar to the end illustrated at the right-hand portions of the rail BR in FIG. 4. The reinforcing elements illustrated in FIG. 4 include the vertically extending reinforcing elements 28 which extend outwardly from the inside surface of the planar element of the rail BR a preselected distance less than the full extension of the vertical reinforcing elements 27. Similarly, a pair of horizontal reinforcing elements 29 (only one illustrated) are arranged in a vertically spaced relationship for defining the ballast storage compartment. The intersections of the reinforcing elements 28 and 29 are provided with a cavity 20 for securing a thread forming fastener. The right-hand end of the top rail 31 is illustrated with a cover 31 secured to the apertures 30 by means of the fasteners 32. With the cover 31 secured in place, the ballast compartment is defined within the confines of the thickness of the bottom rail BR for storing ballast, such as loose sand, or a castable liquid plastic material can be poured into the compartment for permanent installation of the ballast in the rail BR. With the cover 31 secured to the back side of the rail BR, the ballast can be introduced into the thus-defined compartment near the open ends of the rail BR. Loose sand is illustrated in the ballast compartment in FIG. 4. To secure the ballast stored within the thus-defined compartment, the ends of the rail BR are each provided with an end cap 33 which may be readily snap-locked into position for closing off the open ends of the ballast compartment. The construction of the end cap 33 can best be appreciated from examining FIGS. 14–16. The end cap 33 is provided with a multiplicity of spaced apertures 34 arranged along the longitudinal edges of the cap 33. The height of the cap 33 is selected to complete close off the open end of the ballast storage compartment. The cap 33 has a U-shaped configuration with the legs of the U being positioned within the compartment when secured thereto. For this purpose each leg is provided with a tapered lip 33L to permit the cap to be slidably positioned over the end wall of the cover 31 and to be locked thereto by means of the lip 33L; see FIGS. 15 and 16.

With the above-described ballast storage compartments in the bottom rail, approximately 3 pounds of loose, dry sand can be stored in each compartment. With the addition of the 12 pounds of sand, the barricade 20 is essentially the same weight as the prior art barricade of FIG. 1.

In the construction of the barricade 20, it will be noted that the rail members TR and BR extend outwardly from the legs RL and LL a pre-selected distance to appear as the prior art barricade of FIG. 1. This construction of the rail members for the plastic barricade 20 causes it to be the same in appearance as a steel-wooden barricade or a formidable object to be avoided rather than as the present day plastic barricades appear (they appear as lightweight plastic).

An important feature of the present invention is the improved construction of the hinge mechanism H. The hinge mechanism H is constructed with a detent mechanism for minimizing the closing action or reduction of spacing of the legs of the barricade members P comprising the barricade 20 resulting from impacts from winds and wind gusts. Each hinge mechanism H for each barricade member P is constructed identically so as to allow the barricade members P to be interchangeable. Each hinge mechanism H comprises a multiplicity of spaced disk-like elements 40; four such disk-like elements 40 are illustrated in FIG. 6 for each one of the barricade members P. Each of the disk-like elements 40 for a single barricade member P is defined with either a land or a groove on one of the lateral surfaces to co-act with the complimentary land or groove defined on the lateral surface of the elements 40 for a co-acting barricade member P. To facilitate the understanding of the arrangement of the disk-like elements 40 comprising a hinge H, the elements 40 that carry a detent element consisting of a land are identified as the elements 40L, and the elements that carry a detent consisting of grooves carry the reference numeral 40G. The disklike elements 40 that carry the grooves, or the elements 40G, are illustrated in FIG. 7. The grooves in FIG. 7 are identified as HG, and two such grooves are illustrated. One groove HG is arranged in a horizontal orientation (as illustrated in FIG. 7) for co-action with a land on an element 40L so as to interlock the groove with a horizontally oriented land when two barricade members P are pivoted to a fully open position, as in FIG. 2. A second groove HG is arranged at an angular relationship to the horizontally oriented groove HG to receive a coacting land element when the barricade members P are pivoted to a closed position, as illustrated in FIGS. 5 and 6, for example. In FIG. 8 a disk element 40L carrying the land HL is illustrated. The disk 40L carried the land HL that is horizontally oriented on the disk-like element 40L so as to coact with the horizontal groove HG when the barricade members P are in the open position and with the angularly related groove HG when the barricade members P are in the closed position. To further understand the detenting action of the disks 40L and 40G, the elements are further identified in FIG. 6 as to whether they are located on the hinge mechanism illustrated either on the right or the left in FIG. 5. The left-hand hinge mechanism, as illustrated in FIG. 5, is identified as the hinge HL so that its associated disk elements also carry an L notation. Similarly, the hinge element illustrated on the right-hand side of FIG. 5 is denoted as the hinge HR so that its disklike elements carry the notation R. Accordingly, the hinge elements on the left-hand hinge elements will either be identified as a 40GL (left-hand grooved element) or a 40LL element (left-hand land element), while the elements comprising the right hand hinge elements will be identified as 40GR (right-hand grooved element) or 40LR (right-hand land element) and are so identified in FIG. 6. Each of the disks 40 has a central aperture so that when they are arranged together, the apertures for each of the disk elements 40 are coaxial and will receive a hinge pin HP therein. This relationship of the detented hinge elements 40 with the hinge pin HP is best illustrated in FIG. 9.

In the arrangement shown in FIG. 6 the disk elements 40 for the left and right hinge elements HL and HR, as arranged in their closed position in FIG. 5, are each identified in accordance with the above-identified notation. The outside hinge on the left-hand side of FIG. 6 is identified as the element 40LR. The land HL is illustrated in the groove HG for the left-hand hinge element HL or the detenting element 40GL. The next pair of co-acting hinge elements are identified from left to right as the element 40GL and the element 40LR. On the other half of the hinge element the disk-like elements are spaced closer together than for the left-hand side, as is evident from examining FIG. 6. The element closes to the center is the element carrying a land HL and is identified as the element 40LL and is interlocked with the element 40GR. The last two elements are arranged with the left-hand disk element for the hinge HL arranged on the outside and is identified as the element 40LL and is interlocked with the groove HG for the element 40GR. In the barricade closed arrangement shown in FIG. 6, the land elements HL for each disk element 40L are interlocked into the horizontal groove HG, as illustrated in FIG. 7. The interlocked relationship of a land HL and a groove HG is illustrated in FIG. 10. The depth of the land HL for a hinge element is on the order of 0.040 inches and is merely defined of a sufficient height to prevent the unintentional loss of stance in the barricade members P, as discussed hereinabove. The land elements HL interlock with the groove elements HG, which are illustrated in the angular relationship in FIG. 7, when the barricade members P are in the closed position for a specific reason. The single land element HL on the disk element 40L would cold flow if it was not seated in a groove 40G when the members P are in a closed position. This arrangement also prevents the stress cracking of the elements due to the use of the polyethylene plastic for molding the barricade members P and the hinges H. This latter arrangement maintains the integrity of the hinge elements 40 when they are in the closed position. The angular relationship between the groove HG on a horizontal level, as illustrated in FIG. 7, and the angular groove HG is on the order of 40 degrees and conforms with the angular relationship of the stop members SM and the feet PF when the barricade members P are in the fully open position. When the barricade members P are opened up to their full extent, such as illustrated in FIG. 2, the lands HL for the disk elements 40L will have been pivoted from the closed to an open position so as to be interfitted into the angular aligned grooves HG, Stated differently, when the barricade 20 is fully opened, the disks 40L having lands HL will be aligned in the parallel relationship with the angular grooves HG illustrated in FIG. 7 so as to be interfitted to one another for holding the members P in the open position and restrict the unintentional movements of the barricade members P towards one another.

Figure 11:
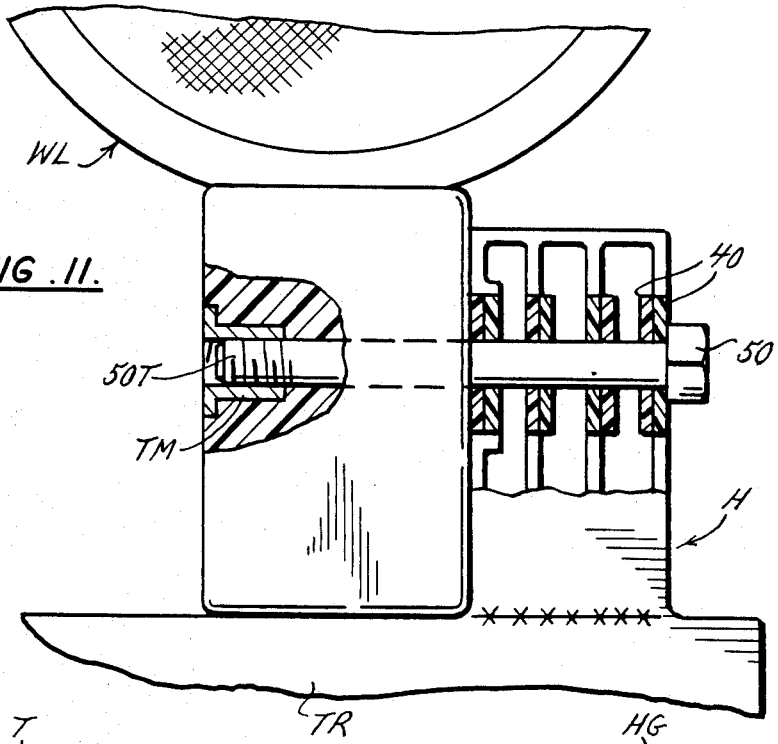
FIG. 11 is a partial view of a barricade, with portions broken away, illustrating the mounting of a warning light on a barricade when it is in the open position by means of a warning light securing member functioning as a hinge pin.
Figure 12:
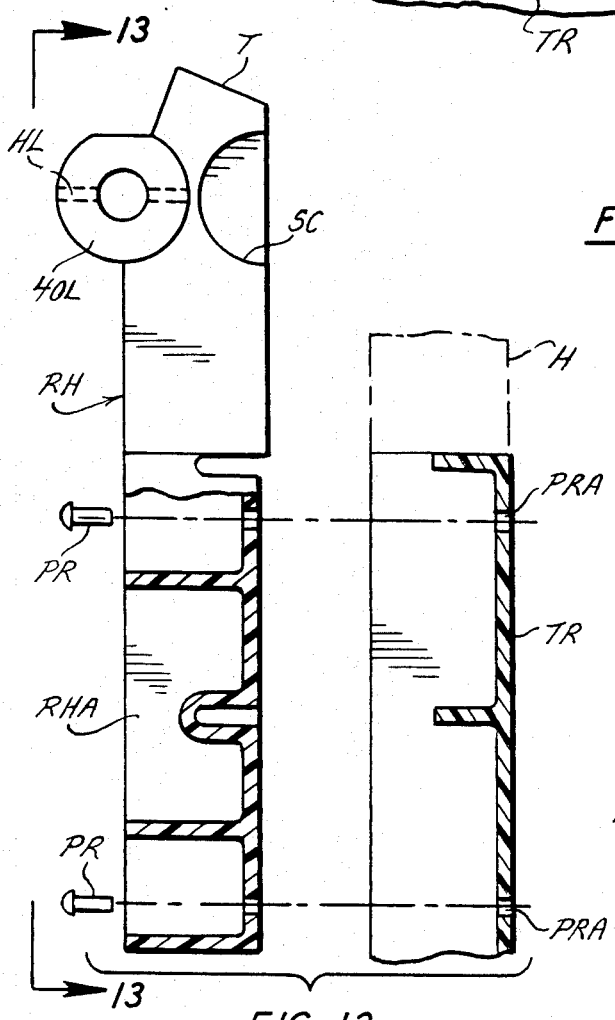
FIG. 12 is a view, partially in elevation and partially in section, of a replacement hinge element illustrated in an exploded relationship relative to the barricade proper and the severed hinge element.
Figure 13:
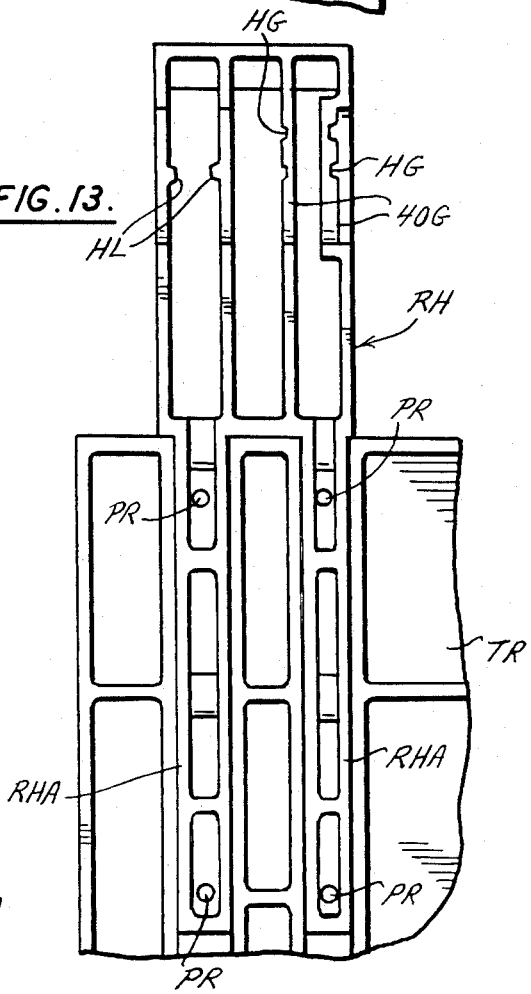
FIG. 13 is a partial, rear elevational view of a barricade member having a replacement hinge element secured thereto.

Now referring to FIGS. 12 and 13, the construction of a replacement hinge RH will be explained. If one of the hinge elements H is damaged in use or on impact, it will render the corresponding barricade member P useless and therefore the barricade 20 inoperative due to the damage to the hinge element H. In accordance with the present invention the damaged hinge element H can be readily replaced through the provision of a replacement hinge identified as the hinge RH in FIGS. 12 and 13. The replacement hinge RH is constructed and defined so it can be readily secured to the barricade member P on the back side of the top rail TR. For this purpose the damaged hinge element H must be severed from the barricade member P proper. With reference to FIG. 11, the hinge H will be severed along the line marked with X's. This will cut off the hinge element H flush with the top of the top rail TR of the damaged barricade member P in preparation for securing the replacement hinge RH in the position previously occupied by the damaged hinge element H. The replacement hinge RH is constructed identically to the original hinge element H except that it is provided with a pair of dependent spaced securing arms that permit it to be secured to the back side of the top rail TR of the damaged member. The securing arms for the replacement hinge RH are illustrated in their secured position in FIG. 13 and are identified as the elements RHA. The elements RHA have a plurality of apertures spaced longitudinally thereon and include four apertures, two in each arm RHA, for receiving a fastener for securing the arms RHA and thereby the replacement hinge RH to the back side of the top rail TR. In preparation for securing the replacement hinge RH in position, four holes are drilled on the front face of the top rail TR in the locations corresponding to the positions illustrated for the fasteners illustrated in FIG. 13. Two such apertures PRA are illustrated for the top rail TR in the right-hand portion of FIG. 12. Once the apertures PRA are all drilled, the replacement hinge RH can be positioned to the rear of the top rail TR to assume the position of the damaged hinge element H, as illustrated in FIG. 13. The fasteners may be pop rivets that are positioned in apertures for the arms RHA to move through the aperture PRA and secure the replacement hinge RH rigidly in the position of the old hinge H (illustrated in dotted outline in FIG. 12). This will render the repaired barricade member P usable once again, and the entire unit need not be replaced as heretobefore has been necessary in the prior art structures.

As is evident from the above discussion, the disk elements 40 for the individual hinge elements H are arranged with their apertures in alignment. A hinge pin HP may be inserted from the outside end of the barricade members P for pivotally securing the barricade members together. The hinge pin HP may be made of plastic and have a construction with a large head at one end, as illustrated in FIG. 9. When no warning light is to be utilized with the barricade 20, a second plastic hinge pin HP would be inserted on the opposite side of the barricade members P for pivotally securing them together. In the event warning lights of conventional construction, such as previously utilized for the prior art barricades of FIG. 1, are employed, the mounting of the warning light WL has been defined relative to the structure of the barricade 20 to permit the warning light WL to be secured in a nonrotatable position to rest on the top surface of the tpp rails TR for the barricade members P, in the manner illustrated in FIG. 2. In the arrangement a conventional securing bolt for the warning light WL is utilized as the securing element for the warning light as well as functioning as a pivot pin for the hinges H, in the manner illustrated in FIG. 11. The warning light WL is of commercial construction and is illustrated the same as the warning lights that are commercially available from the Signal Division of Lear Siegler, Inc., as referenced hereinabove. The warning light housing WLH conventionally emloyed with the warning lights WL has an internally threaded member TM on the side wall of the housing for the warning light to receive a securing bolt. The securing bolt is illustrated in FIG. 11 as a conventional theft-deterent bolt having a threaded end 50T that is secured to the member TM of the warning light WL. The bolt 50 may be any conventional theft-deterent bolt that is normally utilized with the present day commercially available warning lights WL. The warning lights WL may be of a "steady burn" type wherein light is continuously emitted from the light WL or a flashing light in accordance with the requirements at a location at which the barricade 20 is being used. As is evident from examining FIG. 11, the bolt 50 passes through the central apertures of the disk elements 40 for the aligned hinge elements H to secure them in position and to the warning light WL. The mounting of the warning light WL to the barricade 20 is usually accomplished by closing the barricade members P together in the fashion illustrated in FIG. 3. At this time then, the aligned hinge elements 40 receive the bolt 50 and secure the housing WLH for the warning light WL, as described hereinabove. Once the bolt 50 is completely secured, the barricade members P may then be moved to the open position so that the bottom wall of the housing WLH will rest against the top surfaces of the top rails TR.

Another important feature of the present invention is the ability to stack the individual barricade members P in an interlocked relationship, and this will be explained with particular reference to FIGS. 17 and 18. For the purpose of stacking, each of the hinge elements H is defined with a concavity on the opposite side of the hinge element H from the disk elements 40. The stacking cavity is identified in the drawings as the element SC; see FIGS. 4 and 5, for example. The stacking cavities SC are defined with a locking bar SCL intermediate the ends thereof. The locking bar subdivides the cavity SC into left and right-hand portions, and the outer surface of the element SCL is flush with the outer surface of the hinge element H, which is best seen in FIG. 4. In order to stack the barricade members P, the hinge pins HP and/or the bolt 50 must be removed from the hinge elements H so that the barricade members may be stacked one upon another, as illustrated in FIG. 17. The first barricade member P may be mounted on a supporting surface so that its top rail TR engages the mounting surface. With this arrangement the stacking cavity SC for the bottom barricade member P will have its elements SCL engaging the supporting surface; see FIG. 18. In this arrangement the disk-like elements 40 for the hinge element H for the lowest barricade member P will extend above the top planar surface of the barricade member, as illustrated in FIG. 17. The next barricade member P may now be stacked on top of the first barricade member. The arrangement of the second barricade member P, however, is reversed from its normal position of having the interleaving disk elements 40 arranged side by side. The cavity SC for the second barricade member is mounted to receive the disk-like elements 40 of the bottom barricade member P. The cavity SC is sized to snugly receive the disk-like elements 40 therein. In addition, to prevent the relative movement of the stacked barricade members P, the locking elements SCL arranged adjacent to the ends of the cavity SC will protrude between the disk elements 40, as best viewed in FIG. 18. Accordingly, a successive number of barricade members P may be stacked, one upon another, in the same fashion, as described and illustrated in conjunction with FIGS. 17 and 18. With this arrangement a stack of barricade members P approximately 7 feet tall will be interlocked without any appreciable relative movement between the members P and be easy to handle both during manufacturing and during shipment and storage thereof.

We claim:

1. A traffic barricade of the A-frame type comprising first and second barricade planar members constructed and defined for forming an A-frame barricade when the members are pivotably secured together, each of the barricade members being similarly constructed of a lightweight material that will yield when impacted by a motor vehicle so as to minimize any damage to the motor vehicle and barricade, each of the first and second barricade members including an integral hinge member adjacent opposite sides of each barricade member and extending a pre-selected distance from a pre-selected end of the barricade member for pivotable co-action with the corresponding hinge member of the other barricade member when the barricade members are pivotably securfed at said hinge members, hinge means for each of the hinge members for pivotally securing the corresponding hinge members of each of the barricade members to thereby permit the barricade members to be moved to a closed position in a side-by-side relationship and in open position with the remaining ends of the barricade members being spaced apart in an A-frame configuration, each of said integral hinge members having means substantially minimizing any closing pivoting action or gradual closing pivoting action of the barricade members when they are arranged in a A-frame configuration in response to closing forces impacting the barricade members and wherein each of the hinge members extend outwardly of one of the planar sides of the barricade members, the opposite side of the one planar side having a concave element for receiving and holding the extending hinge members for permitting a plurality of barricade members to be stacked in a planar relationship.

2. A traffic barricade of the A-frame type as defined in claim 1 wherein the barricade members are constructed and defined at said pre-selected ends for providing stop means for limiting the pivotable open position of the barricade members to a pre-selected open position that positions said remaining ends of the barricade members in substantially full contact with the supporting surface therefor.

3. A traffic barricade of the A-frame type as defined in claim 1 wherein each of said first and second barricade members are constructed with a first rail member adjacent said ends of the barricade members and a second rail member spaced adjacent the remaining ends of the rail members, said second rail members being constructed and defined for mounting a ballast therein for improving the wind resistance of the thus-defined traffic barricade.

4. A traffic barricade of the A-frame type as defined in claim 1 or 3 wherein the first and second barricade members have interchangeable means constructed of a pre-selected plastic material.

5. A traffic barricade of the A-frame type as defined in claim 3 wherein said second rail members are each constructed and defined with at least a single hollow compartment for receiving and storing ballast therein.

6. A traffic barricade of the A-frame type as defined in claim 5 wherein each of said second rall members has a pair of ballast storing compartments.

7. A traffic barricade of the A-frame type as defined in claim 1 wherein said barricade members are molded from a pre-selected plastic material with sufficient memory to substantially restore itself to its original, usable condition due to an impact or crushing.

8. A traffic barricade of the A-frame type as defined in claim 7 wherein said plastic material is a polyethylene plastic and the barricade members are injection molded from the polyethylene plastic.

9. A traffic barricade of the A-frame type as defined in claim 3 wherein said hinge means comprising removable hinge pins, and said barricade members being constructed and defined for mounting a warning light on said first rail members by means of a threaded hinge pin pivotably securing the corresponding hinge members of each of the barricade members and simultaneously securing a warning light to said hinged members.

10. A traffic barricade of the A-frame type as defined in claim 2 wherein each of the barricade members is constructed and defined for storing ballast therein.

11. A traffic barricade of the A-frame type as claimed in claim 10, wherein each of the barracade members is constructed to have interchangeable means for presenting the forbidding appearance of a metal-wooden A-frame barracade, the barracade members being molded of a preselected plastic material.

12. A traffic barricade of the A-frame type as defined in claim 11 wherein the plastic material is a crushresistant material.

13. A traffic barricade of the A-frame type as defined in claim 3 wherein said integral hinge members extend a pre-selected distance from each of the respective first rail members for each barricade member to permit each of the hinge members to be severed from its individual barricade members in the event a hinge member is rendered inoperative so as to be readily replaced by a replacement hinge member to be secured to the individual barricade member at the location of the severed hinge member.

14. A traffic barricade of the A-frame type as defined in claim 1 wherein each of the hinge members comprises a plurality of spaced disk-like elements, each of the disk-like elements having co-axial apertures for receiving said hinge means therein, the disk-like elements of one of the barricade members being arranged side by side with the disklike elements of the other barricade member when positioned to receive said hinge means for pivotably securing the barricade members together, the engaging surfaces of the disk-like elements for the hinge members having complimentary detenting means for minimizing the closing pivoting action in response to closing forces impacting the barricade members.

15. A traffic barricade of the A-frame type as defined in claim 14 wherein the detenting means comprises complementary shaped lands and grooves arranged on the lateral sides of the disk-like elements for engaging the lands and grooves on different barricade members.

16. A traffic barricade of the A-frame type as defined in claim 15 wherein the disk-like elements have a single detenting land arranged thereon, and the disklike elements have a pair of spaced detenting grooves thereon having a pre-selected radial spacing, the detenting lands for the disk-like elements interlock with the corresponding first detenting groove for a co-acting disk-like element when the barricade members are arranged in an "A" stance and interlocks with the second radially spaced detenting groove when the barricade members are closed together.

17. A traffic barricade of the A-frame type as defined in claim 1 wherein the first and second barricade members include means for interlocking the barricade members for permitting the stacking thereof in a planar relationship when the hinge means are removed from each of the barricade members.

18. Stackable traffic barricade members comprising first and second barricade planar members similarly constructed and defined for forming an A-frame barricade when the barricades are pivotably secured together, each of the barricade members including integral hinge members protruding outwardly from one planar side of each barricade member adjacent the ends thereof, each of said hinge members including concave surfaces having a shape complementary to the protruding hinge members on the opposite sides of the hinge members to permit the first and second barricade members to be stacked in a planar relationship one on top of another when the concave surfaces inter-engage with the hinge members thereby minimizing any relative movement between the thus-stacked barricade members.

19. Stackable traffic barricade members as defined in claim 18 wherein said hinge members comprise a plurality of spaced apart disk-like elements protruding from said one planar side, and said concave surfaces of the hinge members include a locking element arranged intermediate the ends of the concave surfaces for inter-engagement between a pair of disk-like elements for holding the barricade members.

* * * * *

UNITED STATES PATENT AND TRADEMARK OFFICE

CERTIFICATE OF CORRECTION

PATENT NO. : 4,859,983

DATED : August 22, 1989

INVENTOR(S) : Jack H. Kulp et al.

It is certified that error appears in the above-identified patent and that said Letters Patent is hereby corrected as shown below:

Column 1, line 41, delete "motorist" and insert --motorists--.
Column 2, line 65, delete "with" and insert --without--.
Column 3, line 44, delete "as" and insert --a--.
Column 4, line 10, delete "the" and insert --an--.
Column 5, line 20, delete "," and insert --.--.
Column 6, line 21, delete "this" and insert --thin--.
Column 6, line 26, delete "are" and insert --art--.
Column 6, line 61, after "barricade members" insert --P--.
Column 8, line 12, delete "portions" and insert --portion--.
Column 8, line 22, delete "20" and insert --30--.
Column 8, lines 43 and 44, delete "complete" and insert --completely--.
Column 10, line 7, delete "closes" and insert --closest--.
Column 11, line 8, after "member" insert --P--.
Column 11, line 26, delete "aperture" and insert --apertures--.
Column 11, line 50, delete "surface" and insert --surfaces-.
Column 11, line 50, delete "tpp" and insert --top--.
Column 11, line 62, delete "side" and insert --inside--.
Column 13, line 15, delete "securfed" and insert --secured--.
Column 13, line 28, delete "extend" and insert --extends--.
Column 13, line 60, delete "rall" and insert --rail--.
Column 14, lines 21 and 22, delete "crushresistant" and insert --crush-resistant--.
Column 14, line 48, delete "comprises" and insert --comprise--.

UNITED STATES PATENT AND TRADEMARK OFFICE

CERTIFICATE OF CORRECTION

PATENT NO. : 4,859,983

DATED : August 22, 1989

INVENTOR(S) : Jack H. Kulp et al.

It is certified that error appears in the above-identified patent and that said Letters Patent is hereby corrected as shown below:

Column 14, line 54, delete "disklike" and insert --disk-like--.

Signed and Sealed this

Twenty-first Day of August, 1990

*Attest:*

HARRY F. MANBECK, JR.

*Attesting Officer*

*Commissioner of Patents and Trademarks*